US010421574B2

(12) United States Patent
Laib

(10) Patent No.: US 10,421,574 B2
(45) Date of Patent: Sep. 24, 2019

(54) CONTAINER AND CLOSURE WITH ANGLED SPOUT AND INTERIOR SEAL

(71) Applicant: Owens-Brockway Glass Container Inc., Perrysburg, OH (US)

(72) Inventor: Douglas Laib, Perrysburg, OH (US)

(73) Assignee: Owens-Brockway Glass Contaner Inc., Perrysburg, OH (US)

( * ) Notice: Subject to any disclaimer, the term of this patent is extended or adjusted under 35 U.S.C. 154(b) by 0 days.

(21) Appl. No.: 15/898,755

(22) Filed: Feb. 19, 2018

(65) Prior Publication Data

US 2019/0256238 A1 Aug. 22, 2019

(51) Int. Cl.
*B65D 1/02* (2006.01)

(52) U.S. Cl.
CPC ..... *B65D 1/023* (2013.01)

(58) Field of Classification Search
CPC .... B65D 1/0246; B65D 1/023; B65D 1/0223; B65D 39/0058; B65D 39/00; B65D 41/28; B65D 41/0414; B65D 41/0407; B65D 41/04; B65D 41/0435; B65D 41/065
USPC ..... 215/45, 44, 43, 40, 329, 316, 341, 364, 215/355; 220/304, 288, 293, 803, 802, 220/801, 806
See application file for complete search history.

(56) References Cited

U.S. PATENT DOCUMENTS 587,331 A * 8/1897 Rouillot ..... B65D 1/0246 215/43
1,773,291 A 8/1930 Weaver
1,791,787 A * 2/1931 Barroll ..... B65D 1/023 215/398
2,149,906 A * 3/1939 Bell ..... B65D 39/084 220/304
2,340,353 A 2/1944 Weaver
2,768,762 A * 10/1956 Guinet ..... B65D 41/485 215/320
3,454,690 A * 7/1969 Campanelli ..... B65D 1/0246 264/161

(Continued)

FOREIGN PATENT DOCUMENTS

EP 0667300 A1 8/1995
FR 2342910 A1 9/1977

OTHER PUBLICATIONS

International Search Report and Written Opinion, Int. Serial No: PCT/US2019/015810, Int. filed Jan. 30, 2019, Applicant: Owens-Brockway Glass Container Inc., dated May 16, 2019.

*Primary Examiner* — Robert J Hicks

(57) ABSTRACT

A container and associated closure provide an angled spout with a leak free seal. The container and closure are disposed about a longitudinal axis. A neck finish extending from a body of the container includes a spout establishing an axial end surface of the finish located in a plane disposed at a non-perpendicular angle relative to the axis. The finish further includes a radially inner surface including a sealing surface located axially between the axial end surface and the body and disposed at an angle with respect to the axis. The closure includes an annular base wall facing the axial end surface of the finish, radially outer and inner walls extending away from the base wall and a transverse wall extending radially inwardly from the radially inner wall and axially spaced from the base wall. The transverse wall defines a sealing surface configured to seal against the container sealing surface.

18 Claims, 2 Drawing Sheets

(56) References Cited

U.S. PATENT DOCUMENTS

| | | | | | |
|---|---|---|---|---|---|
| 3,722,729 | A | * | 3/1973 | Yamada | B65D 41/185 215/254 |
| 3,825,144 | A | * | 7/1974 | Wiedmer | B65D 41/185 215/320 |
| 3,858,742 | A | * | 1/1975 | Grussen | B65D 41/485 215/253 |
| 3,994,410 | A | * | 11/1976 | Pirgov | B65D 41/185 215/320 |
| 4,925,063 | A | * | 5/1990 | Ali | B65D 1/023 215/216 |
| 5,117,993 | A | * | 6/1992 | Vesborg | B41F 15/0895 215/365 |
| 5,330,083 | A | | 7/1994 | Bartimes et al. | |
| 5,503,308 | A | * | 4/1996 | Young | B65D 1/023 222/529 |
| 5,711,445 | A | * | 1/1998 | Robbins, III | A47G 23/0241 215/384 |
| 6,041,953 | A | | 3/2000 | Goodall | |
| 6,604,642 | B1 | | 8/2003 | Barruw | |
| 2002/0056727 | A1 | | 5/2002 | Brecheisen et al. | |
| 2007/0210123 | A1 | | 9/2007 | Penny et al. | |
| 2014/0166606 | A1 | | 6/2014 | Brozell et al. | |

* cited by examiner

CONTAINER AND CLOSURE WITH ANGLED SPOUT AND INTERIOR SEAL

BACKGROUND a. Technical Field

This disclosure relates to containers and associated closures. In particular, the disclosure relates to a container and closure that provide for an angled spout with an improved seal.

b. Background Art

Containers having angled spouts are desirable because they provide improved pouring of liquids by generating a high flow of a liquid while limiting sloshing or spilling of the liquid. Further, angled spouts provide an improved ergonomic interface for the user. The spout can rest on the lower lip of the user and the user does not have to insert the entire neck of the container within the user's mouth. Forming an angled spout in a container makes it difficult to seal the container, however, and can therefore lead to leaks and/or spoliation of the contents of the container.

The inventor herein has recognized a need for a container and associated closure that will minimize and/or eliminate one or more of the above-identified deficiencies.

BRIEF SUMMARY OF THE DISCLOSURE

This disclosure relates to containers and associated closures. In particular, the disclosure relates to a container and closure that provide for an angled spout with an improved seal.

A container in accordance with one embodiment of the present teachings includes a base, a body extending in a direction away from the base and establishing a longitudinal axis of the container and a neck finish extending in a direction away from the body. The neck finish includes a spout establishing an axial end surface of the neck finish. The axial end surface forms a plane disposed at a non-perpendicular angle with respect to the longitudinal axis. The neck finish further includes a radially outer surface having at least one closure engagement feature projecting away from the outer surface and a radially inner surface including a sealing surface located axially between the axial end surface and the body and disposed at an angle with respect to the longitudinal axis.

A closure in accordance with one embodiment of the present teachings includes an annular base wall disposed about an axis, a radially outer wall extending in a direction away from the base wall and a radially inner wall radially spaced from the radially outer wall and extending in a direction away from the base wall. The closure further includes a transverse wall extending radially inwardly from the radially inner wall and axially spaced from the base wall. The transverse wall defines a sealing surface configured to seal against a corresponding sealing surface of a container.

A container and closure in accordance with the present teachings are advantageous relative to conventional containers and closures. In particular, the inventive container and closure facilitate use of an angled spout, but also provide an improved seal for the container by locating the seal on an internal surface of the container and distant from the rim of the container.

The foregoing and other aspects, features, details, utilities, and advantages of the disclosed system will be apparent from reading the following detailed description and claims, and from reviewing the accompanying drawings illustrating features of this system by way of example.

DETAILED DESCRIPTION

Figure 2:
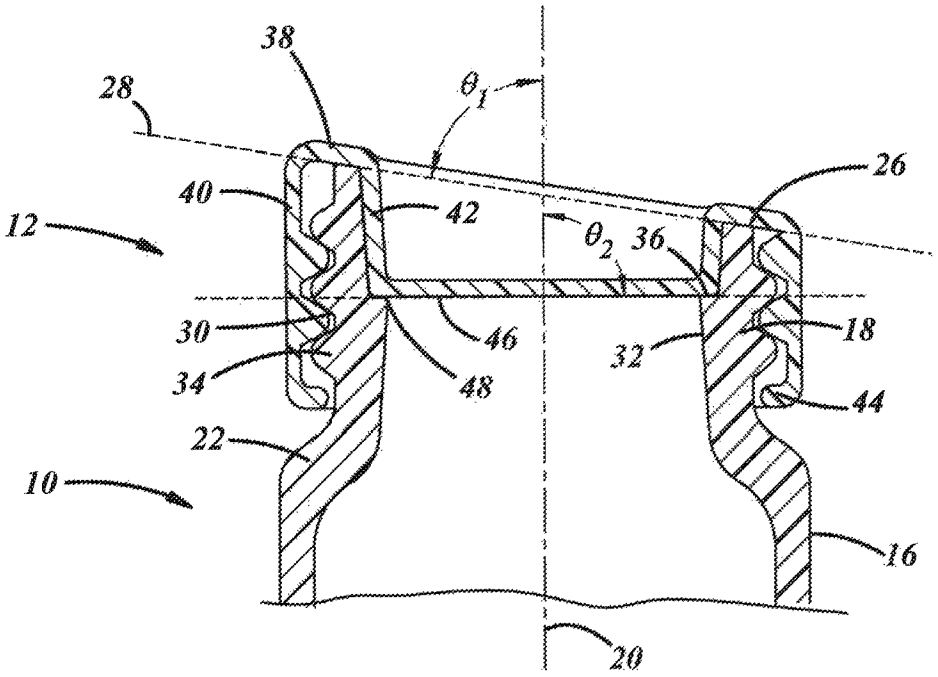
FIG. 2 is a cross-sectional view of a portion of the container of FIG. 1 and a closure for the container.
Figure 1:
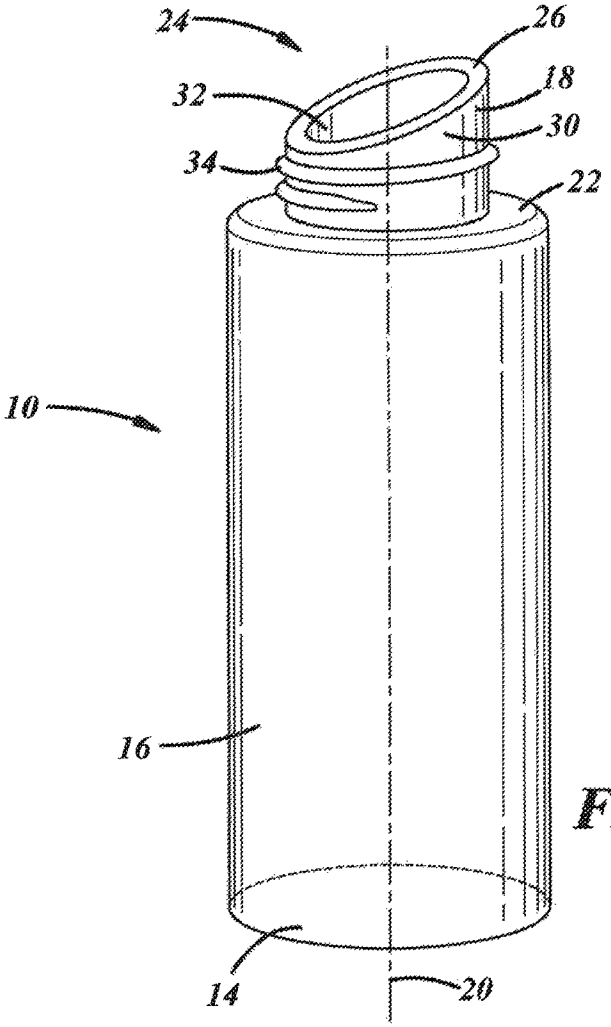
FIG. 1 is a perspective view of one embodiment of a container.

Referring now to the drawings wherein like reference numerals are used to identify identical components in the various views, FIGS. 1-2 illustrate a packaging device including a container 10 and a closure 12 in accordance with one embodiment of the present teachings. The packaging device is provided to store contents. In accordance with some embodiments of the invention, the contents may comprise a liquid such as water. It should be understood, however, that the contents may comprise a variety of different objects including different liquids, foodstuffs, pills, etc.

Container 10 defines a housing for the contents stored within container 10. Container 10 may be made from glass, metals, metal alloy or plastics. Container 10 includes a base 14, a body 16 and a neck finish 18.

Base 14 forms one longitudinal end of container 10. Base 14 is configured to allow container 10 to rest on a surface and, in most cases, a flat surface. In the illustrated embodiment, base 14 is circular in shape and substantially flat. It should be understood, however, that the shape and form of base 14 may vary depending the on the application of base 14. For example, base 14 may be configured for mounting onto an object having a complementary shape.

Body 16 extends in a direction away from base 14 and establishes a longitudinal axis 20 of container 10. Body 16 has a size and shape configured to retain various contents therein. In the illustrated embodiment, body 16 is cylindrical in shape. It should be understood, however, that the shape of body 16 and the dimensions of body 16 may vary. Further, body 16 may be formed to include handles or other ergonomic features.

Figure 4:
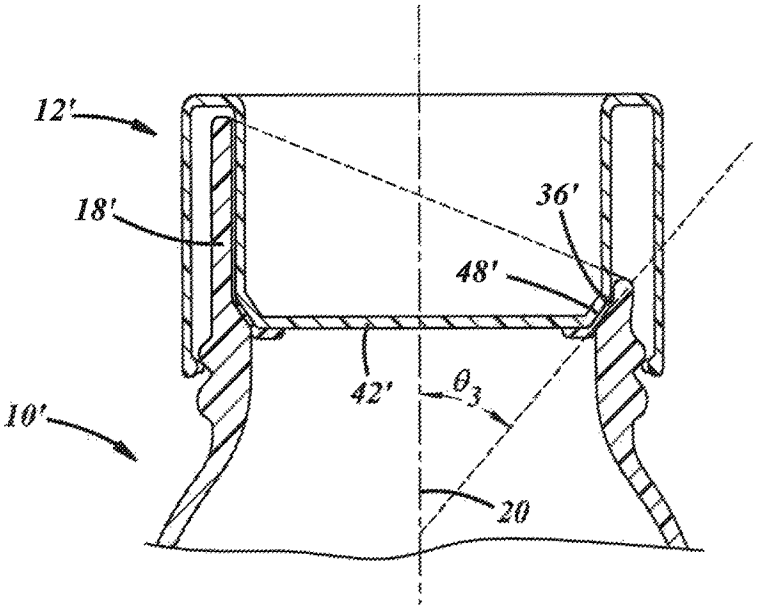
FIG. 4 is a cross-sectional view of a portion of the container of FIG. 3 and a closure for the container.
Figure 3:
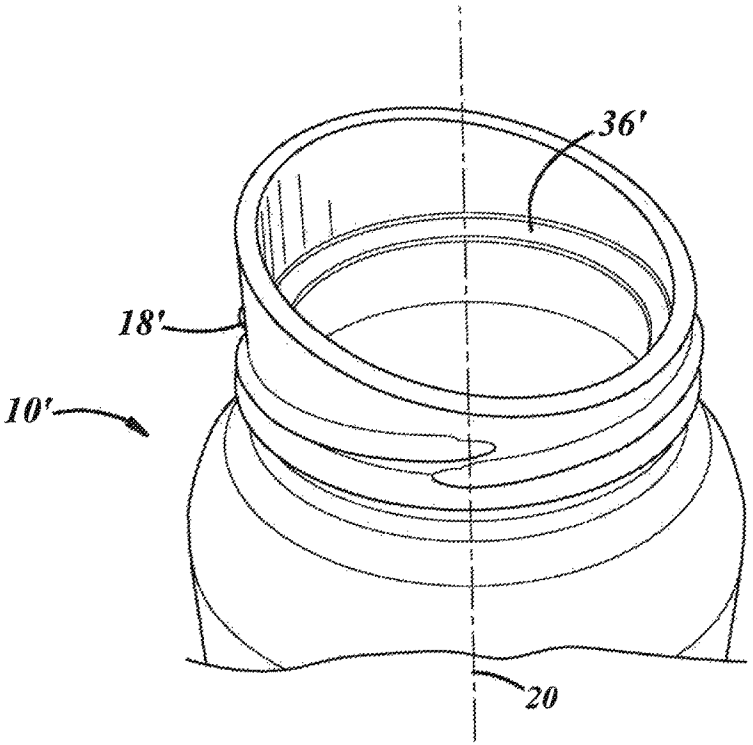
FIG. 3 is a perspective view of another embodiment of a container.

Neck finish 18 defines an opening for ingress and egress of the contents into container 10 and includes means for securing closure 12 to container 10. Finish 18 extends in a direction away from body 16 and may be joined to body 16 at a shoulder 22. Base 14, body 16, and neck finish 18 may comprise a unitary structure (i.e., a one-piece structure without joints) formed, for example, by conventional molding or extrusion processes. Finish 18 includes a spout 24 at one axial end that establishes an axial end surface 26 or rim. The axial length of spout 24 varies about the perimeter or circumference of finish 18 such that surface 26 forms a plane 28 (FIG. 2) disposed at a non-perpendicular angle $\theta_1$ with respect to the axis 20. A radial line along surface 26 may itself be parallel to plane 28 as shown in FIG. 2 or at an angle to plane 28 (including at an angle perpendicular to axis 20). The angle of spout 24 facilitates pouring of liquids by providing for a high flow rate without sloshing or spilling of the liquids. The angle of spout 24 also provides an ergonomic interface for users in circumstances where container 10 contains contents such as drinkable liquids or other foodstuffs. Finish 18 also defines radially outer and inner surfaces 30, 32 adjacent axial end surface 26 and extending from axial end surface 26 in a generally axial direction. Outer surface 30 defines at least one closure engagement feature 34 such as one or more continuous or discontinuous threads or a bead configured to engage a corresponding feature in closure 12. Feature 34 projects away from the surface 30 in a radially outward direction. In accordance with the present teachings, inner surface 32 defines a sealing surface 36 configured to engage a corresponding sealing surface in closure 12. Finish 18 is formed such that an inner diameter of finish 18 varies along the axial length of finish 18 and, in particular, tapers moving in a direction away from end surface 26 to define surface 36. Surface 36 is disposed at a distance from axial end surface 26 such that surface 36 is disposed axially between end surface 26 and body 16 of container 10. Further, surface 36 is oriented at an angle $\theta_2$ with respect to axis 20. In the embodiment of FIG. 2, sealing surface 36 is disposed at a perpendicular angle with respect to axis 20. Referring to FIGS. 3-4, in an alternative embodiment, a container 10' may have a sealing surface 36' that is disposed at a non-perpendicular angle $\theta_3$ with respect to axis 20. In one embodiment, sealing surface 36' may be disposed at an angle between 20 and 70 degrees with respect to axis 20. In the embodiment of FIGS. 3-4, the inner diameter of the neck finish 18' continuously tapers moving along the sealing surface 36' in a direction away from the axial end surface.

Referring again to FIG. 2, closure 12 is provided to close container 10 to prevent the contents of container 10 from exiting container 10 and to prevent outside elements and objects from contaminating the contents of container 10. Closure 12 includes an annular base wall 38 configured to face axial end surface 26 of finish 18 upon assembly of closure 12 to container 10. Base wall 38 is disposed about axis 20 and may be oriented perpendicular to axis 20 or at a non-perpendicular angle to axis 20 (e.g., parallel to plane 28). Closure 12 also includes radially outer and inner walls 40, 42 that are radially spaced from one another and extend in a direction away from base wall 38. Outer wall 40 is configured to face radially outer surface 30 of neck finish 18 upon assembly of closure 12 to container 10. Outer wall 40 includes a container engagement feature 44 projecting radially inwardly and configured to engage closure engagement feature 34 on neck finish 18 of container 10. Feature 44 may, for example, comprise continuous or discontinuous threads, a plurality of circumferentially spaced lugs disposed about axis 20 or a circumferential lip. Inner wall 42 is configured to face inner surface 32 of neck finish 18 upon assembly of closure 12 to container 10 to an axial depth immediately above sealing surface 38. Closure 12 also includes a transverse wall 46. Wall 46 extends radially inwardly from inner wall 42 and closes container 10. In accordance with the present teachings, wall 46 is axially spaced from base wall 38 such that transverse wall is disposed within neck finish 18 distant from axial end surface 26 of finish 18 and between surface 26 and body 16 of container 10. Further, wall 42 defines a sealing surface 48 configured to seal against sealing surface 36 of container 10. Surface 48 may be configured to carry a sealing material such as a plastisol such that the sealing material is disposed between sealing surfaces 36, 48 upon assembly of closure 12 to container 10. Like surface 36 in neck finish 18, surface 48 in closure 12 is disposed at an angle $\theta_2$ with respect to axis 20. In the illustrated embodiment, surface 48 is disposed at a perpendicular angle with respect to axis 20. Referring to FIG. 4, in an alternative embodiment a closure 12' may include a transverse wall 42' having a sealing surface 48' that is disposed at a non-perpendicular angle $\theta_3$ with respect to axis 20. In one embodiment, sealing surface 48' may be disposed at an angle between 20 and 70 degrees with respect to axis 20.

A container 10 or 10' and closure 12 or 12' in accordance with the present teachings are advantageous relative to conventional containers and closures. In particular, the inventive container 10 or 10' and closure 12 or 12' facilitate use of an angled spout 24, but also provide an improved seal for the container by locating the seal on an internal surface of the container 10 or 10' and distant from the rim 26 of the container 10 or 10'.

The disclosure has been presented in conjunction with several illustrative embodiments, and additional modifications and variations have been discussed. Other modifications and variations readily will suggest themselves to persons of ordinary skill in the art in view of the foregoing discussion. For example, the subject matter of each of the embodiments is hereby incorporated by reference into each of the other embodiments, for expedience. The disclosure is intended to embrace all such modifications and variations as fall within the spirit and broad scope of the appended claims.

What is claimed is:

1. A container, comprising:

a base;

a body extending in a direction away from the base and establishing a longitudinal axis of the container; and, a neck finish extending in a direction away from the body and circumscribing the longitudinal axis, and including a spout having an axial length that varies about a circumference of the neck finish and establishing an axial end surface of the neck finish, the axial end surface forming a plane disposed at a non-perpendicular angle with respect to the longitudinal axis, a radially outer surface having at least one closure engagement feature projecting away from the outer surface; and, a radially inner surface including a sealing surface located axially between the axial end surface and the body and disposed at an angle with respect to the longitudinal axis.

2. The container of claim 1 wherein the sealing surface is disposed at a perpendicular angle with respect to the longitudinal axis.

3. The container of claim 1 wherein the sealing surface is disposed at a non-perpendicular angle with respect to the longitudinal axis.

4. The container of claim 3 wherein the sealing surface is disposed at an angle between 20 and 70 degrees with respect to the longitudinal axis.

5. The container of claim 3 wherein an inner diameter of the neck finish tapers moving along the sealing surface in a direction away from the axial end surface.

6. The container of claim 1 wherein the base, the body and the neck finish comprise a unitary structure.

7. A packaging device including the container of claim 1, and a closure comprising:

an annular base wall disposed about the longitudinal axis and facing the axial end surface of the neck finish;

a radially outer wall extending in a direction away from the base wall and facing the radially outer surface of the neck finish;

a radially inner wall radially spaced from the radially outer wall and extending in a direction away from the base wall, the radially inner wall facing the radially inner surface of the neck finish; and, a transverse wall extending radially inwardly from the radially inner wall and axially spaced from the base wall, the transverse wall defining a sealing surface configured to seal against the sealing surface of the container.

8. The packaging device of claim 7 wherein the sealing surface of the transverse wall of the closure is disposed at an angle with respect to the longitudinal axis of the container.

9. The packaging device of claim 8 wherein the sealing surface of the transverse wall of the closure is disposed at a perpendicular angle with respect to the longitudinal axis of the container.

10. The packaging device of claim 8 wherein the sealing surface of the transverse wall of the closure is disposed at a non-perpendicular angle with respect to the longitudinal axis of the container.

11. The packaging device of claim 7 wherein the closure includes a sealing material carried on the sealing surface of the transverse wall of the closure.

12. The packaging device of claim 7 wherein the radially outer wall of the closure includes a container engagement feature configured to engage the closure engagement feature of the container.

13. The packaging device of claim 7 wherein the sealing surface of the neck finish is disposed at a perpendicular angle with respect to the longitudinal axis.

14. The packaging device of claim 7 wherein the sealing surface of the neck finish is disposed at a non-perpendicular angle with respect to the longitudinal axis.

15. The packaging device of claim 7 wherein the base, the body and the neck finish comprise a unitary structure.

16. A package, comprising:

a container, comprising:

a base;

a body extending in a direction away from the base and establishing a longitudinal axis of the container; and a neck finish extending in a direction away from the body, and including a spout establishing an axial end surface of the neck finish, the axial end surface forming a plane disposed at a non-perpendicular angle with respect to the longitudinal axis, a radially outer surface having at least one external thread; and a radially inner surface including a sealing surface located axially between the axial end surface and the body and disposed at an angle between 20 and 70 degrees with respect to the longitudinal axis; and a closure for the container, comprising:

an annular base wall disposed about an axis;

a radially outer wall extending in a direction away from the base wall and radially spaced away from the radially outer surface of the container neck finish, and including at least one internal thread;

a radially inner wall radially spaced from the radially outer wall and extending in a direction away from the base wall; and, a transverse wall extending radially inwardly from the radially inner wall and axially spaced from the base wall, the transverse wall defining a sealing surface disposed at an angle between 20 and 70 degrees with respect to the longitudinal axis and configured to seal against the corresponding sealing surface of the container.

17. The package of claim 16 wherein the sealing surface of the transverse wall of the container carriers a sealing material.

18. The package of claim 16 wherein the container neck finish circumscribes the longitudinal axis, and the spout has an axial length that varies about a circumference of the neck finish.

* * * * *